United States Patent [19]

Reith

[11] 4,226,548

[45] Oct. 7, 1980

[54] PARTS CLEANING APPARATUS

[75] Inventor: Kuno W. Reith, San Francisco, Calif.

[73] Assignee: Steam Stores, Inc., Saratoga, Calif.

[21] Appl. No.: 935,631

[22] Filed: Aug. 21, 1978

[51] Int. Cl.[3] ..... B08B 3/02; B08B 3/10

[52] U.S. Cl. ..... 401/188 R; 401/15; 134/111; 210/222; 417/420

[58] Field of Search ..... 401/15, 188 R, 189; 134/109, 110, 111; 210/222; 417/420

[56] References Cited

U.S. PATENT DOCUMENTS

| | | | |
|---|---|---|---|
| 3,096,776 | 7/1963 | DeWitt | 134/111 |
| 3,819,293 | 6/1974 | Zitzmann | 417/420 |
| 3,850,184 | 11/1974 | Fossati et al. | 134/111 |
| 3,869,391 | 3/1975 | Kramer | 210/222 |
| 3,890,988 | 6/1975 | Lee | 134/104 |
| 3,929,433 | 12/1975 | Lucero | 210/222 |
| 3,971,394 | 7/1976 | Osborne | 134/104 |
| 4,105,342 | 8/1978 | Plourde | 401/15 |

*Primary Examiner*—William Pieprz
*Attorney, Agent, or Firm*—Claude A. S. Hamrick

[57] ABSTRACT

A parts cleaning apparatus including a fluid container at least partially filled with a solvent, a tray disposed on top of and draining into the container, at least one hollow brush for brushing a dirty part held over the tray and a pump for pumping solvent from the container through the hollow brush.

8 Claims, 8 Drawing Figures

PARTS CLEANING APPARATUS

BACKGROUND OF THE INVENTION

1. Field of the Invention

This invention relates generally to cleaning machines and more particularly to industrial parts cleaning machines.

2. Description of the Prior Art

In auto shops, machine shops, factories and other heavily industrialized places of business, there is a need for a cheap, effective way to clean dirt and grime from parts and assemblies of parts. Parts have been traditionally cleaned by immersing them in a bucket of solvent and then scrubbing them with a brush. The problem with the bucket cleaning method is that the first few parts being washed contaminate the solvent with particulate matter, sludge, dirt and oil so that subsequently washed parts never become quite clean.

Furthermore, with the bucket cleaning method the solvent must be renewed frequently so that parts can be cleaned adequately. Since the solvents are typically petroleum based, frequent solvent replacement can be quite expensive, and will become more expensive as petroleum products become increasingly scarce.

There are numerous parts cleaners found in the prior art which include a container filled with a solvent, a tray disposed over the container and draining thereinto, and a means for pumping solvent from the container to a nozzle which empties onto the tray. Dirty parts are washed under the stream of solvent flowing from the nozzle.

The above-described type of parts cleaner suffers from the same problems as the bucket method does, namely, that the solvent becomes contaminated with dirt and sludge in a very short order, and thus never really cleans subsequently washed parts.

To overcome the problem of solvent contamination, various parts cleaners include single or multiple filters to remove contaminants from the solvent. One such parts cleaner is disclosed in U.S. Pat. No. 2,438,654 of V. N. Albertson which teaches a fluid reservoir, a work table disposed on top of the reservoir, a nozzle draining onto the work table, and means for pumping solvent through an array of filters from the reservoir to the nozzle.

Another recirculating parts cleaning apparatus is disclosed in Swiss Pat. No. 467,876 of A. Milts which discloses an apparatus including a barrel containing a solvent, a washing trough disposed on top of the barrel having a drain pipe leading to the bottom of the barrel, an intake pipe for drawing solvent from near the center of the barrel, and a pump for pumping solvent through the intake pipe and out a hollowed brush member draining into the washing trough.

A problem with parts cleaners found in the prior art is that they do not adequately allow for the sedimentation of particulate matter from the solvent prior to pumping the solvent to the part being cleaned. Also, the filters used in the prior art parts cleaners frequently become clogged and need to be replaced. Lastly, parts cleaners found in the prior art have seals that can be attacked by caustic elements in the solvents which can cause the seals to degenerate and eventually fail.

SUMMARY OF THE INVENTION

In view of the above discussion, it should be apparent that a major objective of this invention is to provide a parts cleaning apparatus which adequately cleans the solvent solution before it is pumped to a dirty part. Furthermore, it is an object of this invention to accomplish this cleaning without the need for costly and often replaced filters.

Another object of this invention is to provide a parts cleaning apparatus that has no rotary seals that can be attacked by caustic elements present in the solvent solutions.

Briefly, my invention comprises a fluid container at least partially filled with a solvent, a tray having a base portion provided with a drain hole disposed on top of the container, a screen disposed over the base portion of the tray, a splash shield attached to a rear wall portion of the tray, a pumping mechanism attached to the splash shield, a drain pipe leading from the drain hole of a bottom layer of the solvent within the internal volume of the container, an intake pipe extending between a central layer of the solvent within the container and the inflow of the pumping mechanism, a hollow brush, and a flexible hose connecting the outflow of the pumping mechanism to the hollow brush so that the pump can pump solvent from the container through the brush and onto a part to be cleaned.

An advantage of my invention is that it does not require costly filters to clean the solvent.

These and other objects and advantages of my present invention will no doubt become apparent to those skilled in the art upon a reading of the following detailed description of a preferred embodiment of my invention as accompanied by the several figures of the drawing.

In the drawing

DETAILED DESCRIPTION OF THE PREFERRED EMBODIMENT

Figure 1:
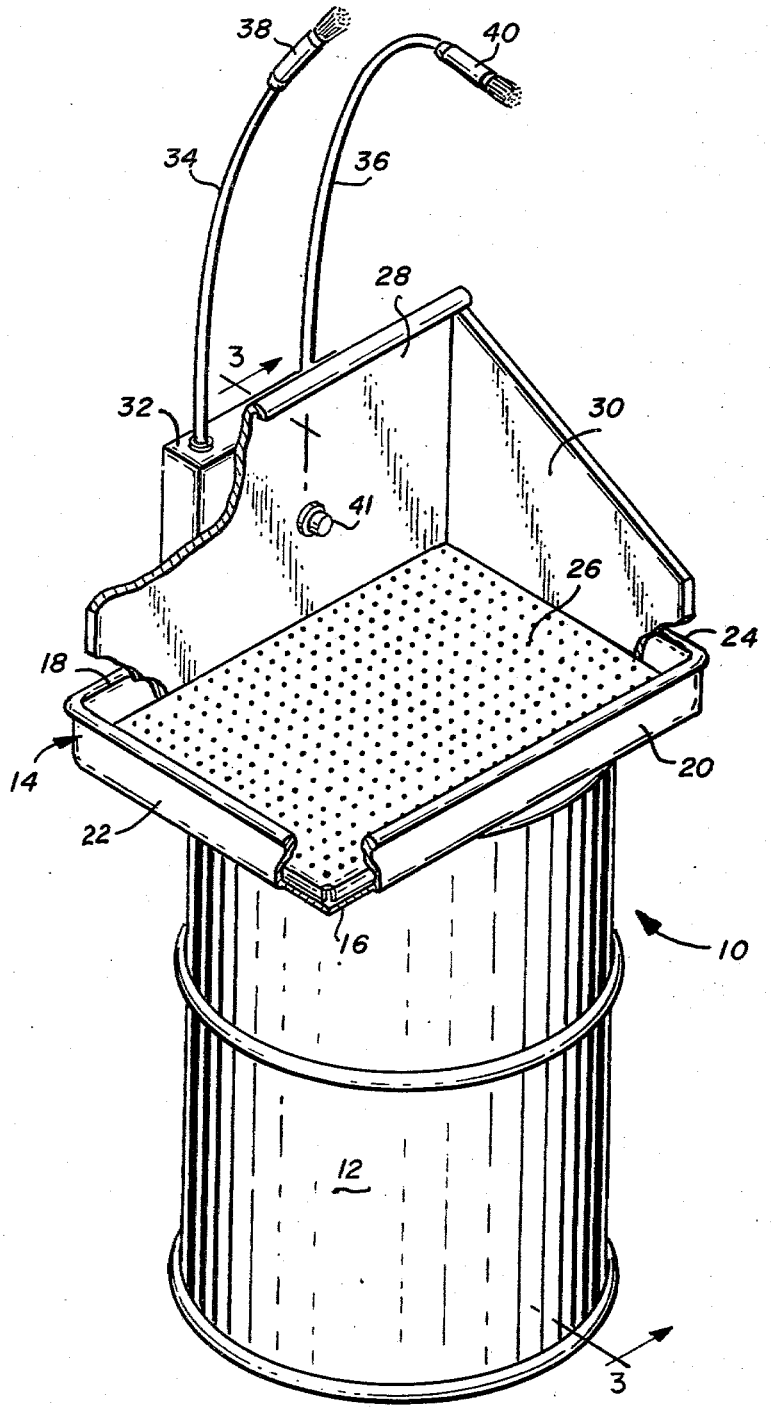
FIG. 1 is a perspective view of a parts cleaning apparatus in accordance with my present invention.

Referring now to FIG. 1, a parts cleaning apparatus 10 in accordance with my present invention includes a fluid container such as a fifty-five gallon drum 12, and a washing tray 14 including a base portion 16 and four upwardly extending wall portions. The wall portions of the tray include a rear wall portion 18, a front wall portion 20, a left wall portion 22, and a right wall portion 24.

Disposed above the base portion of the tray is a screen 26 upon which a part that is to be cleaned can be supported. A rear splash shield 28 is attached to rear wall portion 18 and extends upwardly from the base portion of the tray at approximately right angles relative thereto. This preferred embodiment of my parts cleaning apparatus is also provided with a side splash shield 30 which is attached to right wall portion 24.

A pump mechanism 32 is attached to the rear surface of splash shield 28 and has a first flexible hose 34 and a second flexible hose 36 extending therefrom to which are attached hollow brushes 38 and 40, respectively. The brushes each have a handle provided with an axially formed bore and a bundle of bristles partially disposed with the bore at one end of the handle. When a solvent carrying hose is attached to the other end of the handle, solvent can flow through the bore and out through the bristles of the brush. A pump on-off switch 41 is disposed through an aperture formed in rear splash shield 28 so that an operator can switch on and off the pump mechanism.

In use, a part that is to be cleaned is supported against or over screen 26, the pump mechanism is turned on by switch 41, and one or both of brushes 38 and 40 are brushed against the exposed surfaces of the part so that solvent pumped by pump mechanism 32 bathe the part in clean, pure solvent. The solvent then flows through screen 26 and back into drum 12.

Figure 2:
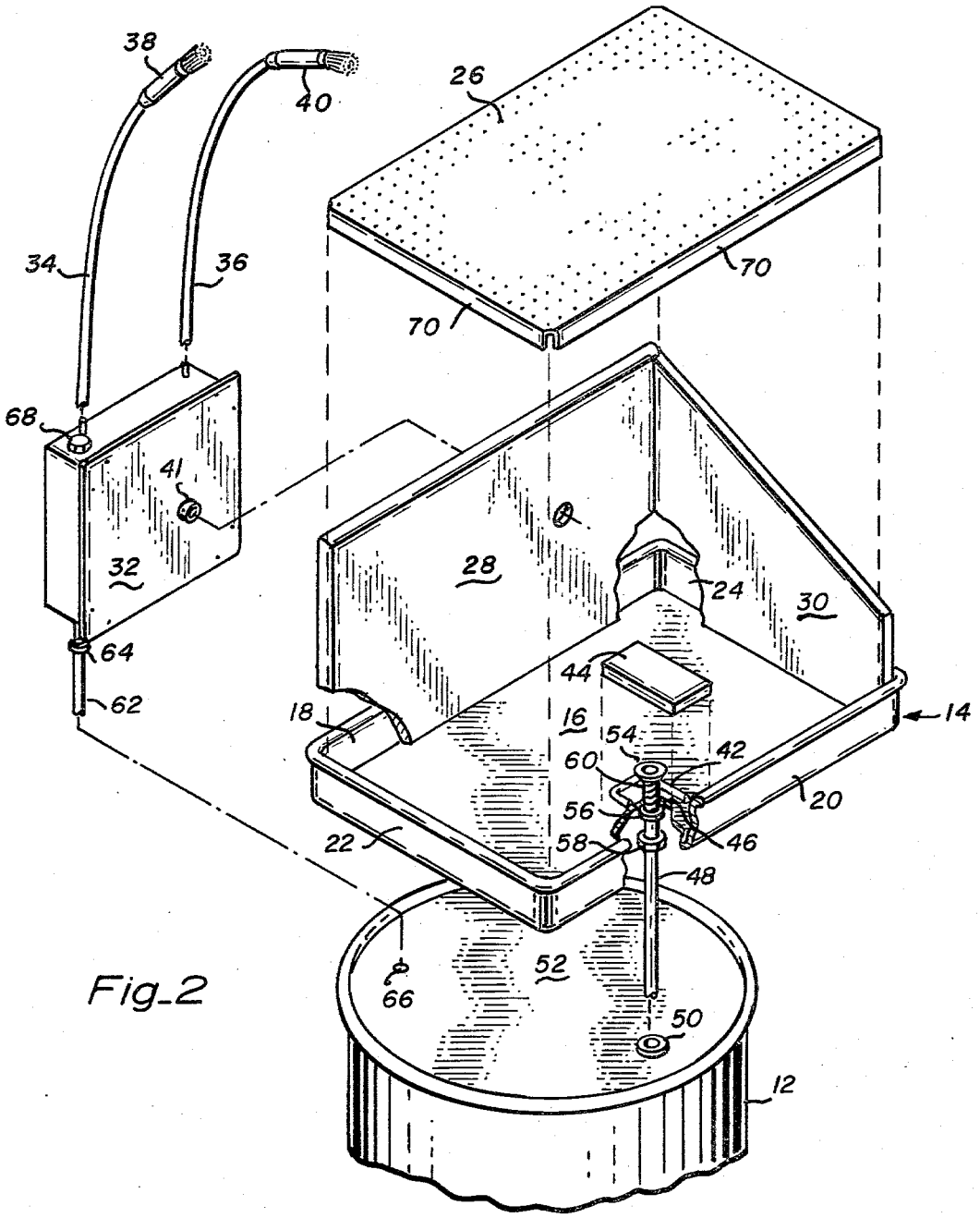
FIG. 2 is a partially exploded perspective view of the parts cleaning apparatus shown in FIG. 1.

In the exploded perspective view of FIG. 2, the various component parts of my apparatus can be more clearly seen. Also, seen for the first time in this figure is a sludge trap comprising a ridge 42 formed upwardly from base portion 16 and a cover 46 which is disposed over ridge 42. The ridge surrounds a drain hole 46 through which a drain pipe 48 is disposed. The second end of drain pipe 48 extends through an aperture 50 formed in a drum lid 52 and extends into the solvent contained in drum 12. A flanged end 54 of drain pipe 48 is held in position at drain hole 46 by an "O" ring 56 and a nut 58 which engages threads 60 formed about the drain pipe just below the flanged portion.

Also seen for the first time in this figure, is an intake pipe 62 having a first end connected to an inflow 64 of pump mechanism 32 and having a second end disposed through an aperture 66 formed in lid 52 and extending down into the solvent contained by drum 12. A magnetic plug 68 is also seen, which will be discussed in detail with reference to later figures. Screen 26 can be seen to have downwardly depending tab portions 70 which space the upper portion of the screen above base portion 16. The upper portion of screen 26, in this preferred embodiment, comprises a solid metal plate having staggered 0.127 inch holes formed along a plurality of center lines separated by 3/16ths of an inch. This produces a screened surface that is 34% open and yet which is very strong and rugged. Besides providing a support surface on which parts can be washed, the screen also prevents small parts from being carried by the solvent into drum 12, and further increases the safety of my apparatus by providing a fire screen which isolates any solvent that is pooled on base portion 16 of the tray from sparks, flames and any other combustion initiating sources.

Figure 3:
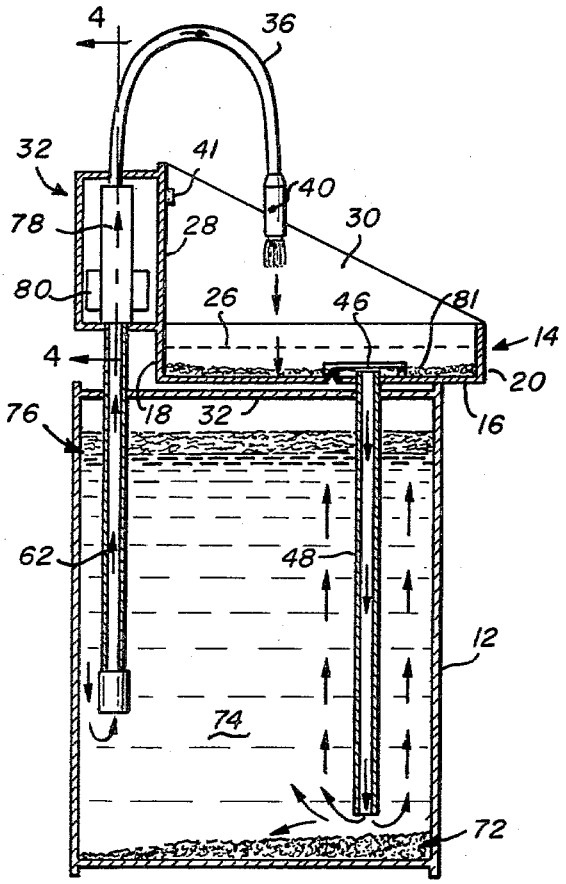
FIG. 3 is a cross-sectional view taken along line 3—3 of FIG. 1.

Referring now to the cross-sectional view of FIG. 3, it may be seen that drain pipe 48 extends to near the bottom of drum 12 while intake pipe 62 extends only about two-thirds of the way down into the drum. My apparatus is constructed in this way so that sludge and heavy particles that are carried into the drum will collect in a bottom layer 72 of the solvent leaving a clarified layer 74 of the solvent that intake pipe 62 can draw upon. Light oil and dirt will float to a top layer 76 of the solvent and thus will be prevented from being sucked into the intake pipe 62.

Included in pump mechanism 32 is a sedimentation tube 78 and a pump 80. The pump draws solvent up through intake pipe 62 through sedimentation tube 78 and then pumps it out the brushes via the flexible tubes. The solvent then flows through screen 26 and drain hole 46 leaving most of the heavy dirt 81 behind on top of base portion 16.

Figure 4:
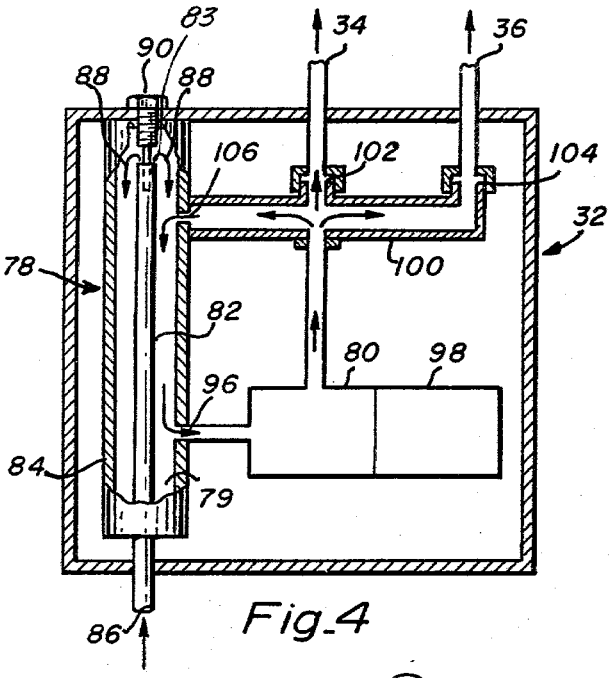
FIG. 4 is a cross-sectional view taken along line 4—4 of FIG. 3.

In FIG. 4, which is a cross-section taken along 4—4 of FIG. 3, the internal arrangement of the components of pump mechanism 32 may be seen. Sedimentation tube 78 includes an inner tube 82 and an outer tube 84. The inner tube 82 extends up into outer tube 84 to define an intake port 83 which is near the top of the sedimentation device. Solvent from intake pipe 62 enters inner tube 82 at an inflow 86 and rises in the tube to empty at 88 into the chamber defined between inner tube 82 and outer tube 84.

Outer tube 84 of my present embodiment is of a substantially rectangular cross section. However, other embodiments may utilize a cylindrical tube 84 since the shape of the outer tube is not critical to the operation of the sedimentation tube.

Figure 5:
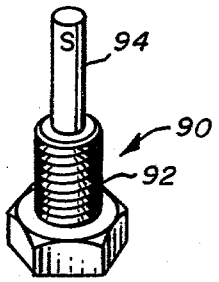
FIG. 5 is a perspective detail view further illustrating the magnetic plug of FIG. 4.

Just before the solvent flows out of inner tube 80, it passes by a magnetic plug 90 disposed through upper portions of the pump mechanism housing and outer tube 84. Referring briefly to FIG. 5, it can be seen that magnetic plug 90 comprises a threaded body portion 92 and a cylindrical magnet portion 94. When the solvent flows by cylindrical magnet portion 94 any ferromagnetic particles carried by the solvent are trapped thereupon.

Referring again to FIG. 4, the solvent in outer tube 78 is drawn out through a first output port 96, while any sediment carried by the solvent is left behind in the bottom of the sedimentation tube at 79. Pump 80, which is driven by a motor 98, then pumps the solvent into an output manifold 100. The output manifold has output ports 102 and 104 and which comprise the outflow of the pumping mechanism which are connected to the ends of hoses 34 and 36. Also provided is a small aperture 106 which allows the manifold to communicate with the chamber of the sedimentation tube. Aperture 106 provides for a self-priming feature of my pumping mechanism 32 by assuring that outer tube 84 is always filled at least to the level of the small aperture so that pump 80 won't go dry. When my parts cleaning apparatus is used for the first time, the pump must be manually primed by filling outer tube 84 with a solvent. This is accomplished by removing magnetic plug 90 and pouring solvent through the plug hole and into the chamber of the sedimentation tube.

Referring now generally to FIGS. 1–5, when pumping mechanism 32 is actuated by switch 41, solvent from clarified layer 74 is drawn into intake pipe 62 and from there into inner tube 82 of sedimentation tube 78. It is then drawn past a magnetic plug 90 to remove any ferromagnetic particles and down into outer tube 84 of sedimentation tube 78. After depositing any sediment it may be carrying upon the bottom of the sedimentation tube, the solvent is pumped by a pump 80 into an output manifold 100 where a fraction of the solvent is returned to the sedimentation tube through an aperture 106 and the remainder of the solvent is delivered to tubes 34 and 36. The solvent then flows out of hollow brushes 38 and 40 to wash parts disposed on top of screen 26. The used solvent drains through screen 26 and down drain pipe 48 into drum 12 to leave heavy dirt 81 behind. The solvent is released by drain pipe 48 near the bottom of drum 12 so that any sludge settles within bottom layer 72 of the solvent and any light oils or dirt drift to the top layer 76 of the solvent to leave clean solvent in clarified layer 74.

Thus, there are three separate, nonfiltering sedimentation stages which clean the solvent, namely the sedimentation stage taking place in drum 12, the sedimentation stage taking place in sedimentation tube 78 and sedimentation stage taking place on top of the bottom portion of the tray.

Figure 6:
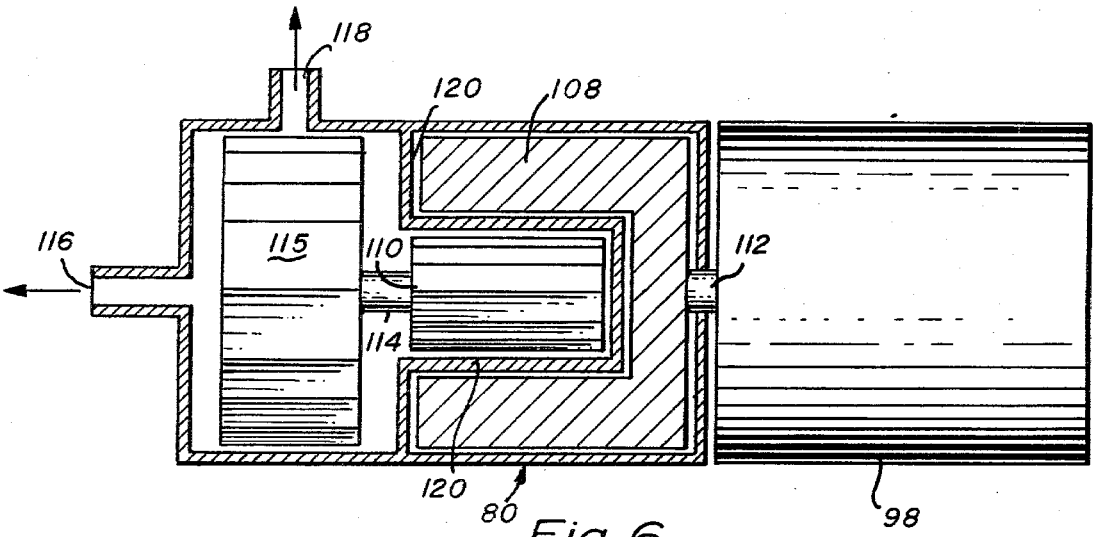
FIG. 6 is a partially broken detail view further illustrating the pump and motor of FIG. 4.

Referring now to FIG. 6, a preferred pump and motor assembly is illustrated. In this embodiment, pump 80 is of the magnetic type including a first magnetic rotor 108 and a second magnetic rotor 110. When first magnetic rotor 108 is rotated by shaft 112 of motor 98, rotor 110 is likewise rotated due to its magnetic coupling with the first rotor. Rotor 110 is connected by a shaft 114 to an impeller 115 which draws solvent from the sedimentation tube through an input port 116 and pumps solvent to the output manifold through an output port 118. Because the first and second rotors are magnetically coupled, they can be separated by an impermeable wall 120 to completely protect motor 98 from the caustic elements in the solvent solution. Thus, by utilizing a magnetic pump, the solvent is never in contact with a sliding or stationary seal to cause possible erosion and leakage.

Figure 7:
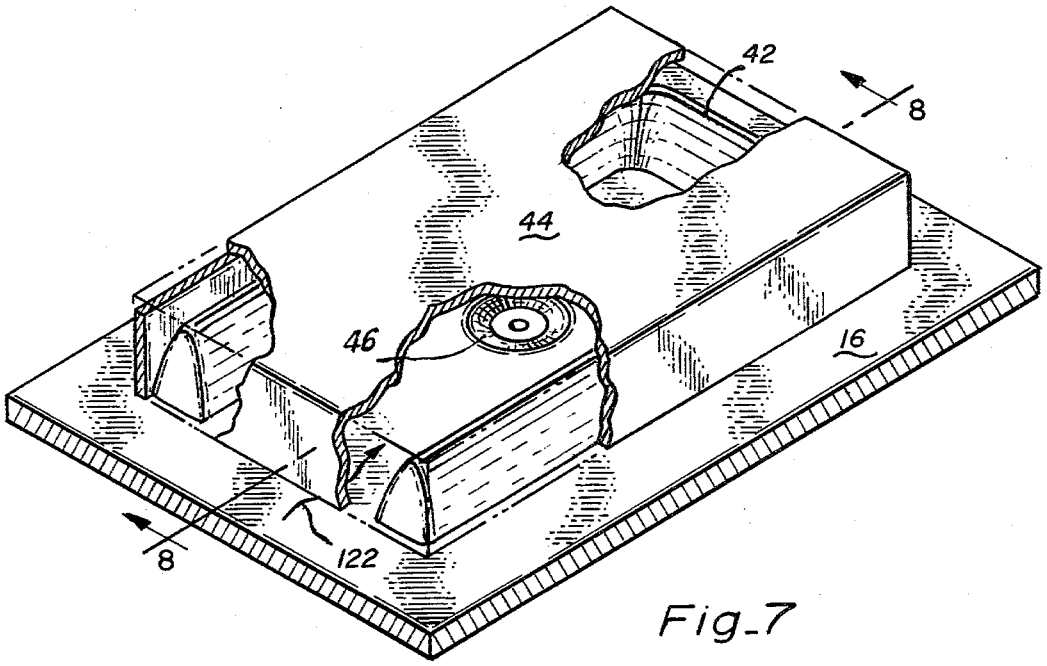
FIG. 7 is a perspective detail view of part of the base portion of the washing tray shown in FIGS. 1 and 2.
Figure 8:
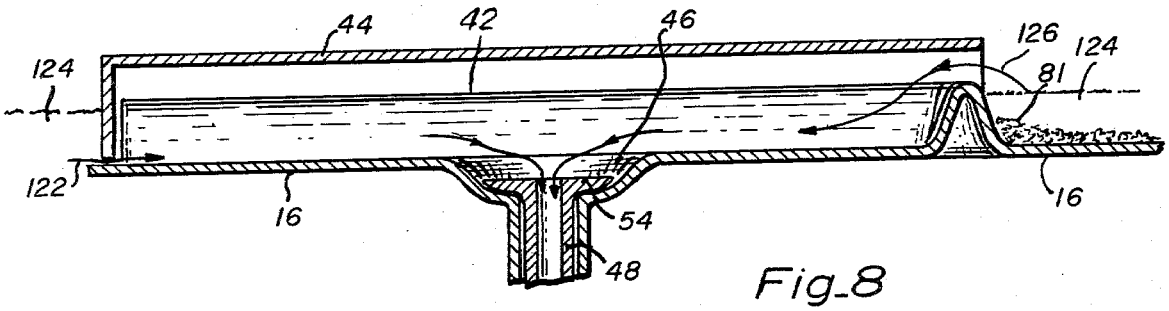
FIG. 8 is a cross-sectional view taken along line 8—8 of FIG. 7.

Referring now to FIGS. 7 and 8, the sludge trap of my present invention can be more clearly seen. The ridge 42 of the sludge trap is created by forming a part of base portion 16 into the U-shaped fold shown. Cover 44 is substantially rectangularly box-shaped having its bottom portion and one side portion removed. The cover loosely rests on top of base portion 16 and does not form a seal therewith. Solvent can loosely flow under the side of cover 44 that is not adjacent to a portion of ridge 42 as is illustrated by the arrow at 122. Since the solvent flows under the cover at 122 extremely slowly, it has a tendency to pool on base portion 16 until it becomes higher than ridge 42 (approximately $\frac{1}{4}$ of an inch), at which time it will flow over the ridge at 126. By allowing the solvent to temporarily pool on the base portion in this manner, heavy dirt 81 is deposited on the bottom of the base portion and thus is not circulated throughout the system. However, after the unit is turned off, all of the solvent will flow through under the cover at 122 and back into the drum so that excessive surface evaporation of the expensive solvent solution is prevented.

While this invention has been described in the light of a specific preferred embodiment, it is contemplated that modifications thereof will become apparent to those skilled in the art after having read the preceding description of the preferred embodiment. It is therefore intended that the following appended claims be interpreted as covering all such modifications as fall within the true spirit and scope of this invention.

What is claimed is:

1. A parts cleaning apparatus for use in cooperation with a fluid container at least partially filled with a solvent, comprising:

a tray means disposed on top of said container and including a base portion provided with a drain hole, and four upwardly extending wall portions including a rear wall portion, a front wall portion and two side wall portions;

screen means disposed over said base portion;

a rear splash shield attached to said rear wall portion and extending upwardly from said base portion;

pumping means including a substantially vertical sedimentation tube means having a first intake port and a first output port;

a magnetic pump means having a second intake port coupled to said first output port, and having a second output port, whereby said pump draws solvent through said sedimentation tube and into said second intake port and ejects the solvent from said second output port;

an output manifold disposed below said first intake port and above said second intake port and having a third intake port coupled to said second output port, and a third output port;

drain pipe means having a first end disposed through the drain hole of said base portion and having a second end disposed proximate the bottom of said container;

a U-shaped ridge means formed around said drain hole of said base portion for restricting fluid flow about said drain hole;

a cover means having a rectangularly-shaped top portion and three downwardly depending side portions, said cover means being adapted to cover said U-shaped ridge means and said drain hole, whereby sediment is restricted from flowing out of said drain hole by the cooperation between said ridge means and said cover means;

intake pipe means having a first end connected to said first intake port and having a second end disposed within the solvent of said fluid container, the second end of said intake pipe means being further from the bottom of said container than said second end of said drain pipe means;

first flexible hose means connected at a first end to said third output port; and hollow brush means connected to a second end of said first flexible hose means, whereby solvent may be drawn from said container through said intake pipe, pumped through said flexible hose means and out of said hollow brush means by said pumping means to clean a part, after which the solvent drains through said screen means and down said drain pipe back into said container.

2. A parts cleaning apparatus as recited in claim 1 further comprising:

a side splash screen attached to one of said side wall portions and extending upwardly from said base portion.

3. A parts cleaning apparatus as recited in claim 1 further comprising:

magnetic plug means extending into said first intake port of said sedimentation tube means, whereby ferromagnetic particles carried by said solvent as it enters said first intake port adhere to said magnetic plug means and thus are removed from the solvent.

4. A parts cleaning apparatus as recited in claim 3 wherein said sedimentation tube means is comprised of;

an outer tube having said first output port disposed above the bottom thereof and forming a sedimentation chamber therebetween; and an inner tube extending into said outer tube and having an upper end defining said first intake port and a lower end coupled to said intake pipe means, said input end being adapted to receive said magnetic plug means in such manner that fluid flowing into said sedimentation tube means passes so close to said magnetic plug means that magnetic particles contained therein are attracted thereto and captured thereby.

5. A parts cleaning apparatus as recited in claim 1 further comprising:

interflow means for allowing said fluid to flow from said sedimentation tube into said output manifold, said interflow means being disposed below said first intake port and above said second intake port, whereby fluid is maintained within said sedimentation tube means at least to the level of said interflow means so that said magnetic pump means is primed.

6. A parts cleaning apparatus as recited in claim 1 wherein said output manifold further includes a fourth output port and further comprising:

a second flexible hose means attached at a first end to said fourth output manifold; and a second hollow brush means attached to a second end of said second flexible hose means, whereby solvent fluid may be caused to flow through said second hollow brush means and onto a part to be cleaned.

7. A parts cleaning apparatus as recited in claim 1 wherein said screen member comprises:

a flat, planar member provided with a plurality of small holes; and tabs formed downwardly from said planar member to contact said base portion.

8. A parts cleaning apparatus for use in cooperation with a fluid container at least partially filled with a solvent, comprising:

a tray means disposed on top of said container and including a base portion provided with a drain hole, and four upwardly extending wall portions including a rear wall portion, a front wall portion and two side wall portions;

screen means disposed over said base portion;

a rear splash shield attached to said rear wall portion and extending upwardly from said base portion;

pumping means including a substantially vertical sedimentation tube means having a first intake port and a first output port, said sedimentation tube means including an outer tube having a bottom and a top with said output port being disposed in a wall thereof above said bottom so as to form a sedimentation chamber therebetween, and an inner tube means coupled to said intake pipe means and having an upper end extending into said outer tube and forming said first intake port proximate said top;

magnetic plug means disposed to extend into said sedimentation tube means and be received within said upper end such that fluid flowing out of said upper end and into said sedimentation chamber is caused to flow proximate said magnetic plug means, said plug means being operative to attract and capture metalic particles carried by the fluid;

a magnetic pump means having a second intake port coupled to said first output port, and having a second output port, whereby said pump draws solvent through said sedimentation tube and into said second intake port and ejects the solvent from said second output port;

an output manifold disposed below said first intake port and above said second intake port and having a third intake port coupled to said second output port, and a third output port;

drain pipe means having a first end disposed through the drain hole of said base portion and having a second end disposed proximate the bottom of said container;

intake pipe means having a first end connected to said first intake port and having a second end disposed within the solvent of said fluid container, the second end of said intake pipe means being further from the bottom of said container than said second end of said drain pipe means;

first flexible hose means connected at a first end to said third output port; and hollow brush means connected to a second end of said first flexible hose means, whereby solvent may be drawn from said container through said intake pipe, pumped through said flexible hose means and out of said hollow brush means by said pumping means to clean a part, after which the solvent drains through said screen means and down said drain pipe back into said container.

* * * * *